United States Patent [19]

Imagumbai et al.

[11] Patent Number: 4,790,885

[45] Date of Patent: Dec. 13, 1988

[54] METHOD OF PRODUCING HIGH TENSILE-HIGH TOUGHNESS STEEL

[75] Inventors: Masana Imagumbai; Rikio Chijiiwa; Naoomi Yamada, all of Kimitsu, Japan

[73] Assignee: Nippon Steel Corporation, Japan

[21] Appl. No.: 753,079

[22] Filed: Jul. 9, 1985

[30] Foreign Application Priority Data

Jul. 10, 1984 [JP] Japan ..... 59-142898

[51] Int. Cl.[4] ..... C21D 8/02

[52] U.S. Cl. ..... 148/2; 148/12.4

[58] Field of Search ..... 148/12 R, 12 F, 12.4, 148/2

[56] References Cited

U.S. PATENT DOCUMENTS 4,572,748 2/1986 Suga et al. ..... 148/12 F
4,591,396 5/1986 Mazuda et al. ..... 148/12 F

FOREIGN PATENT DOCUMENTS 0043866 1/1982 European Pat. Off. .
58-77527 5/1983 Japan .
58-153730 9/1983 Japan .

*Primary Examiner*—Christopher W. Brody
*Attorney, Agent, or Firm*—Pollock, Vande Sande & Priddy

[57] ABSTRACT

A method for manufacturing high tensile-high toughness steel plate, which the first step 15 preparing a steel slab or ingot consisting essentially, by weight, of 0.03 to 0.20% C
0.01 to 0.70% Si
0.50 to 1.80% Mn lesser concentrations of titanium, zirconium, and mobium, and balac iron.

The second step is rolling the slab or ingot with an accumulated rolling reduction of at least 30% in a temperature range between ($Ar_3$+150° C.) and $Ar_3$ in a cooling after casting, or in another cooling after reheating a cold steel slab in a temperature range between 1000° C. and 1300° C.

The third step is quenching the rolled steel from a temperature not less than ($Ar_3$−30° C.) within a period of time in which neither recovering nor recrystallization substantially occur.

The fourth step is tempering at a temperature of not higher than $Ac_1$.

4 Claims, 2 Drawing Sheets

(x 200)

(x 200)

(x 500)

(x 500)

(x 500)

METHOD OF PRODUCING HIGH TENSILE-HIGH TOUGHNESS STEEL

BACKGROUND OF THE INVENTION

1. Field of the Invention

This invention relates to a method for producing a high tensile-high toughness steel plate for welded structures, having a tensile strength of not less than 50 $Kg/mm^2$ by a direct quenching after rolling and tempering process.

2. Description of the Prior Art

It is known that a steel plate manufacturing process in which a rolled plate is directly quenched and tempered, which is generally called "direct quenching and tempering process" (hereinunder referred to as "DQT" process), can reduce manufacturing costs because it enables the omission of the reheating step in the manufacturing process of a conventional quench-and-tempered steel. In addition, since this process can generally obtain higher strength in comparison with a process in which a rolled plate is reheated before quenching (hereinunder referred to as "QT" process), it can reduce the amount of alloys to be added, whereby the cost for alloying elements is reduced and also toughness of weld joints as well as weldability is improved pronouncedly.

For example, the gist of the DQT process disclosed in Japanese Laid-Open Patent Publication Nos. 153730/1983 and 77527/1983 resides in the following:

(i) the compositions of a steel are intended for welded structures and are determined in consideration on the toughness of weld joints and cold cracking property in weld zone;

(ii) a quenching starting temperature is not less than $Ar_3$ and, after rolling, both the recovery and recrystallization of the roll-worked structure are accelerated until the commencement of quenching, and/or steel chemistry is limited not to form such precipitates as to restrain the above-mentioned $\gamma$-recrystallization beheviour.

(iii) after quenching, the plate is tempered by reheating it at a temperature of not higher than $Ac_1$.

The conventional DQT process, however, is defective in that the low temperature toughness of DQT plates is inferior to that of a steel plate produced by the QT process. The conventional direct quenching (hereinunder referred to as "DQ") process is aimed at improving quench hardenability at the time of DQ by recovering and recrystallizing the roll-worked structure. For that purpose, for example, in the method disclosed in Japanese Post-Exam Patent Publication No. 3011/1983, a rolled material is subjected to hot rolling in a manner of a total rolling reduction of not less than 50% in the temperature range of not lower than the $Ar_3$ transformation point, finishing the steel plate to a predetermined plate thickness. It, however, requires to hold rolled plates isothermally or to cool them slowly for 1 to 15 minutes in a temperature range between a temperature less than the $Ac_3$ transformation point and the $Ar_3$ transformation point, followed by quenching.

In such a DQ process, since the roll-worked structure is recovered and recrystallized in the isothermally holding stage or the cooling stage, the size of the quenched microstructure produced by the DQ process is approximately equivalent to the size of austenite grain existing immediately before quenching. Since the austenite grain size immediately before the DQ step is relatively coarse, it is scarecely possible to obtain adequate low temperature toughness after being subjected to the DQT process. On the other hand, in the prior method concerning on DQ process, it fails to obtain adequate quench hardenability, hence it is unable to get the aimed strength after DQT process, as far as the roll-worked structure is neither recovered nor recrystallized.

SUMMARY OF THE INVENTION

Accordingly it is an object of the invention to provide a process of obtaining a fine quenched structure, unlike the conventional DQT process, without the recovering and/or recrystallizing of the roll-worked structure. It is also the aim of the invention not to degrade the quench hardenability notwithstanding the adoption of the DQ process from the roll-worked $\gamma$-structure.

To achieve the aim of producing a high tensile-high toughness steel plate, this invention provides a method of producing a high tensile-high toughness steel plate, which comprises the first step of preparing a steel slab or ingot consisting essentially, by weight, of 0.03 to 0.20% C
0.01 to 0.70% Si
0.50 to 1.80% Mn
one or two selected from the group consisting of 0.005 to 0.05% Ti and 0.005 to 0.05% Zr,
0.005 to 0.10% Nb,
not greater than 0.025% P,
not greater than 0.015% S,
not greater than 0.080% Al
not greater than 0.0030% N, and the balance Fe and impurities incidentally mixed in the normal steel manufacturing process; and having a value not smaller than 0.60 of $D_1$* defined by formula (1) described below, the second step of rolling the slab or ingot with an accumulated rolling reduction of at least 30% in a temperature range between ($Ar_3$+150° C.) and $Ar_3$ in a cooling after casting, or in another cooling after reheating a cold steel slab or ingot in a temperature range between 1000° C. and 1300° C., the third step of quenching the rolled steel from a temperature not less than ($Ar_3$−30° C.) within a period of time in which neither recovering nor recrystallization substantially occur, and the fourth step of tempering at a temperature of not higher than $Ac_1$, Formula (1):

$$D_I^* = 1.11\sqrt{C}\,(1 + 0.7Si)\,(5.1Mn - 1.12)$$

(unit of each component represents weight %).

This invention also provides another method which comprises the first step of preparing a steel slab or ingot consisting essentially, by weight, of 0.03 to 0.20% C,
0.01 to 0.70% Si,
0.50 to 1.80% Mn,
one or two selected from the group consisting of
0.005 to 0.05% Ti and 0.005 to 0.05% Zr,
0.005 to 0.10% Nb,
not greater than 0.025% P,
not greater than 0.015% S,
not greater than 0.080% Al,
not greater than 0.0030% N,
one or two selected from the group consisting of
not greater than 0.0030% B, not greater than 0.50% Mo,
not greater than 0.50% Cr,
not greater than 4.00% Ni,
not greater than 1.00% Cu,
not greater than 0.0080% Ca and
not greater than 0.030% REM and, the balance Fe and impurities incidentally mixed in the normal steel manufacturing process; and having the value not smaller than 0.60 of $D_I^*$ defined by formula (2) described below, the second step of rolling the slab or ingot with an accumulated rolling reduction of at least 30% in a temperature range between ($Ar_3$+150° C.) and $Ar_3$ in a cooling after casting, or in another cooling after reheating a cold steel slab or ingot in a temperature range between 1000° C. and 1300° C., the third step of quenching the rolled steel from a temperature not less than ($Ar_3$−30° C.) within a period of time in which neither recovering nor recrystallization substantially occur, and the fourth step of tempering at a temperature of not higher than $Ac_1$.

Formula (2):

$$D_I^* = 1.11\sqrt{C}\,(1 + 0.7Si)\,(5.1Mn - 1.12)\left[\tan^{-1}\left\{5 + \left(\frac{10^4 \times B}{4}\right)^2\right\} - 1.09\right] \times (1 + 3Mo)(1 + 2.16Cr)(1 + 0.36Ni)(1 + 0.365Cu)$$

(unit of each constituent represents weight %).

The reason why and how the range of each component of a steel is determined as described above will be described below.

Since C is an essential element which controls the strength of steel, less than 0.03% C makes it difficult to keep the quench hardenability of a steel. On the other hand, an increase in the amount of C deteriorates properties against cold cracking in weld portion and lowers the notch toughness of a weld joint. Thus, the upper limit thereof is set at 0.20%.

Elements such as Si, P, S and Al are not so important in this invention, and from the consideration on the level of the present industrial technologies concerning production of high tensile steel plates for welded structures, to which the invention is to be applied, Si is set at 0.01 to 0.70%, P at not greater than 0.025%, S at not greater than 0.015% and Al at not greater than 0.080%.

Mn is as important as C and controls the hardenability of steel and at the same time it has great influence on the value of $Ar_3$ which essentially relates to the constitution of the invention. Accordingly, if the amount of Mn is too small, the value of $Ar_3$ becomes too high to suppress the recovering and recrystallizing of the roll-worked structure which is introduced by the rolling work in the temperature range between ($Ar_3$+150° C.) and $Ar_3$, resulting in pronouncedly short time recover and recrystallization of the structure which is substantially relating to the invention. Thus, the lower limit of Mn is determined at 0.50%. On the other hand, the upper limit thereof is determined at 1.80% from the viewpoint of improving the property against cold weld cracking and for facilitating the production of molten steel.

Addition of Ti and Zr is effective for improvement of notch toughness of the heat-affected zone of weld joints by virtue of the TiN and ZrN which precipitate in steel.

On the other hand, if the amount of Ti and Zr is excessive, it forms TiC and ZrC, which disadvantageously harden the heat-affected zone of a weld joint and lower the notch toughness. Therefore, the upper limits of Ti and Zr are determined at 0.05%, respectively.

Nb remarkably delays the recrystallization and recovery of the worked structure of austenite, whereby Nb is useful in bringing about fine transformed structure in a $\gamma$ grain which is characteristic to this invention. This effect is not obtained if the amount of Nb is smaller than 0.005%, while if it is greater than 0.10%, it degrades the resistivity against cold cracking and also lower the notch toughness of weld joints.

N relates to important constitution requisite of the invention to obtain a fine transformed structure in $\gamma$ grains by way of rolling work with the accumulative rolling reduction of not smaller than 30% at a temperature between ($Ar_3$+150° C.) and $Ar_3$, followed by quenching from a temperature not lower than ($Ar_3$−30° C.) within a period of time in which neither recovering nor recrystallizing substantially occur. If N content is high, such fine transformed structure within $\gamma$ grains can not be obtained.

Thus, the upper limit of N is set at 0.0030%.

B is effective to enhance $D_I^*$ and the strength of steel in this invention, however, if excessive amount of B is added, the $Ar_3$ transformation point becomes high and it becomes impossible to obtain such effect of the rolling work on the refinement of quenched structure which is essential constitution requisite of the invention as described in the case of insufficient Mn. In the case of adding B, therefore, the upper limit is set at 0.0030% and the lower limit at 0.0003%, because the above-described effect is not obtained if the amount thereof is less than 0.0003%.

Mo is very effective in lowering $Ar_3$ and hence in enhancing the effect of the invention, but too much Mo suffers poor weldability and deterioration of the notch toughness of weld joints. The upper limit is therefore determined at 0.50%.

V and Cr lessen temper softening and are effective for obtaining high strength, but too much additioning of the elements suffers poor weldability and deterioration of the notch toughness weld joints. The upper limits of V and Cr are therefore set at 0.20% and 0.50%, respectively.

Ni and Cu are generally not so effective in enhancing the strength of quenched and tempered steel, but are effective in improving low temperature toughness of a steel plate. According to this invention the effect is remarkably enhanced. Accordingly, the high amount addition of Ni and Cu is preferred. It, however, is difficult to find the significance of Ni-additioning more than 4% in the economical consideration of the industry. Therefore the range of Ni is determined not to exceed 4.00% in this invention. With respect to Cu, since excessive amount of Cu is apt to cause hot cracking and flaws on the surface of a steel plate, the upper limit thereof is set at 1%.

Ca and REM have the function of reducing the undesirable influence of MnS on the impact toughness of a steel plate. In killed steel with low S content, the effect is brought about by changing MnS into CaS or RES-S as far as the added amount of them is limited within the optimum range. If the amount thereof is excessive, however, oxidic inclusions in the form of cluster are formed and tend to induce internal defects in steel products. The upper limit of Ca is, therefore, set at 0.0080% and that of REM at 0.030%.

The reasons for restricting the amount of each essential component are described above. In addition, in order to quench the hot-rolled steel keeping desirable roll-worked structure which this invention aims at, it is essential to meet such conditions that the value of $D_I^*$ defined by the formula (1) is not smaller than 0.60, and that the slab or ingot rolled with the accumulative rolling reduction of not less than 30% at a temperature between ($Ar_3$+150° C.) and $Ar_3$ should be quenched at a temperature of not less than $Ar_3$−30° C. within a period of time in which neither recovery nor recrystallization thereof occurs substantially. If both of these conditions are not satisfied, sufficient effects will not be obtained.

According to the method of the invention, it becomes possible to obtain a fine quenched structure not withstanding the DQ is done within neither recovery nor recrystallization of the hot roll-worked structure occurring without deteriorating the quench hardenability of steel because of the reasons described below.

When a slab or ingot is directly quenched after hot-rolling within the recrystallization range of austenite phase in accordance with the prior art using the ordinary industrial manufacturing facilities, the rolled structure easily recovers and recrystallizes before the initiation of DQ. As a result, as is shown in FIG. 2(*a*), the martensite structure is obtained (it means quench hardenability is assured), however, the martensite grows up to nearly the same size as the coarse austenite grain. Thus, such DQ material becomes inferior in low temperature toughness even if it is tempered. In order to improve the toughness of the steel after the DQT treatment, if the slab or ingot is rolled in a non-recrystallizing range of austenite and then is subjected to DQ so as to make austenite grains fine, polygonal ferrite appears preferentially both from the austenite grain boundaries and from deformation band in austenite grains, as shown in FIG. 1*b*. Hence, sufficient hardening can not be obtained. The polygonal ferrite appears at an usually higher temperature than the ordinary estimated $Ar_3$ bar the natural cooling after rolling.

As a result of various studies on the reason for ferrite nucleation at such high temperature, which is observed in the steel plate rolled in austenite-nonrecrystallizing range, the inventors have found that, in low nitrogen steel having a value of not smaller than 0.60 regarding $D_I^*$ which is defined by the formula (1) or (2), such ferrite (polygonal ferrite) is not formed, and that if the steel is quenched at a temperature not less than ($Ar_3$−30° C.) within the duration of time in which the worked structure introduced by the hot rolling with accumulative rolling reduction of not smaller than 30% within the austenite-nonrecrystallizing temperature range is substantially neither recovered nor recrystallized, that is, within 120 second, preferably 60 seconds, and more preferably 30 seconds, the fine martensite structure (hereinunder referred to as "CR-DQ structure") shown in FIG. 2(*c*) which is finely divided by ferrite plates arranged in such regularly oriented directions as shown in FIG. 2(*c*) is obtained, which ferrite plate differ from the polygonal ferrite referred to above. In this case, the duration of time between the finishing of rolling and the commencement of quenching is essentially critical for obtaining such CR-DQ structure. That is, as shown in FIG. 2, in a case where DQ is effected at a time duration of 20 seconds from the rolling finish, the typical CR-DQ structure (FIG. 2(*c*)) can be obtained. However, in another case where the DQ is effected at a time duration of 120 seconds from the rolling finish, the feature of the resultant CR-DQ structure is reduced. Further, in the other case where the DQ is effected at a time duration of 180 seconds from the rolling finish (FIG. 2(*a*)), none of the characteristics of the CR-DQ structure can be obtained, that is, the martensite grain size corresponds to the size of recrystallized austenite grains. As a result, although the three kinds of DQ steel plates are subjected to the same hot-rolling practise using the same material and also are subjected to the same quenching from the austenite single phase, the low temperature toughness of the three DQ steel plates exhibits quite different values. In a case where the DQ steel plate having the CR-DQ structure is tempered, the low temperature toughness exhibits superior to any other one, although the strength is approximately the same as that of a plate having no CR-DQ structure.

The above and other objects, features and advantages of the present invention will become clear from the following description of the preferred embodiments thereof, taken in conjunction with the accompanying drawings.

BRIEF DESCRIPTION OF THE DRAWINGS

FIG. 1(*b*) is a photograph (magnified 200 times) of steel plate No. (B - 5) of as-directly-quenched state;

FIG. 2(*b*) is the same photograph of steel plate No. (C - 2) as in FIG. 2(*a*); and FIG. 2(*c*) is the same photograph of steel plate No. (C - 3) as in FIG. 2(*a*).

DESCRIPTION OF THE PREFERRED EMBODIMENTS

Embodiment 1

Examples of research regarding the influences of process condition and the relationship between nitrogen amount in steel and the strength and toughness of steel plate:

Table 1 shows the components of sample steel used in the experiments for determining optimum conditions for the process and the amount of N in steels. Table 2 shows the process conditions adopted for the steels shown in Table 1 together with the strength and toughness of the steel plates. As is shown in Table 1, the amount of N of steel D is 0.0037%, which exceeds those of steels A, B and C produced in accordance with the invention. As shown in Table 2, the value of Charpy vTrs of the DQT plate D is inferior to those of other DQT plates A, B and C although the process condition of the plate D are in the scope of the present invention. On the other hand, although the components of the steels A, B and C are in the scope of the invention, the steel plates quenched at the lapse time of 180 and 300 seconds between the rolling finish and the commencement of DQ process are inferior to others in both strength and Charpy vTrs after DQT, because $\gamma/\alpha$ transformation had started in the course of air cooling prior to the DQ, hence the quenching was incomplete.

Figure 1A:
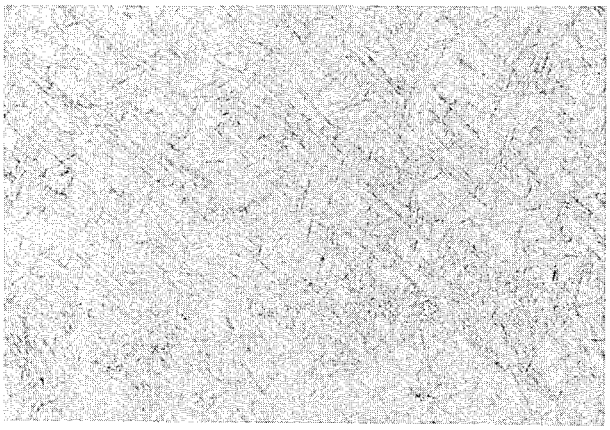
FIG. 1(*a*) is a photograph (magnified 200 times) of the microstructure of steel plate No. (B - 4) in the Embodiment 1.
Figure 1B:
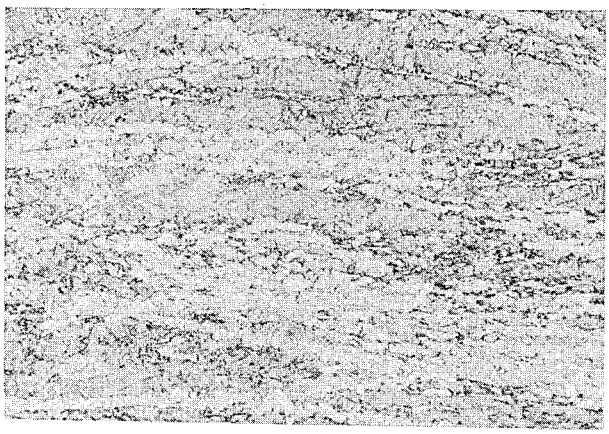
Figure 2A:
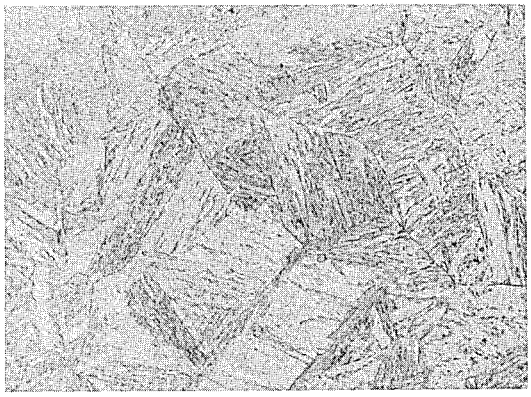
FIG. 2(*a*) is a photograph (magnified 500 times) of the microstructure of steel plate No. (C - 1) of as-DQ state in Embodiment 1.
Figure 2B:
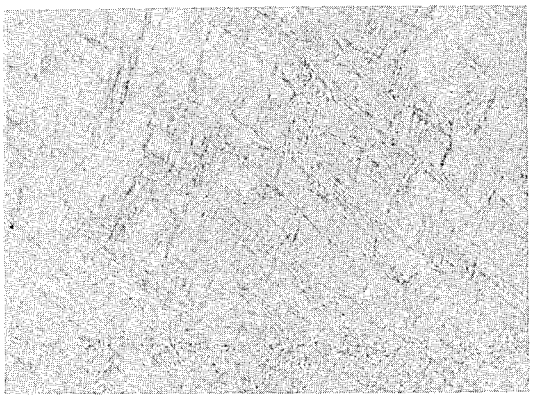
Figure 2C:
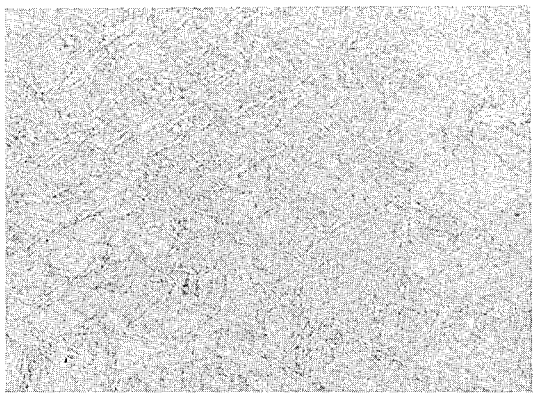

FIG. 1 shows the micro-structure of the steel plates B - 4 and B - 5 in the DQ state. As is shown in FIG. 1(*a*), the steel plate B - 4 which was quenched 120 seconds after rolling has no polygonal ferrite in the grain boundary, and shows superior strength and toughness, as is shown in Table 2. On the other hand, in the case of the steel plate B - 5 (FIG. 1(*b*)) which is directly quenched after 180 seconds from the rolling finish, grain boundary ferrites are observed, which means imcomplete quenching. Thus it is well understood that the steel plate B - 5 is remarkably inferior to the steel plate B - 4 in strength and toughness. A similar relationship was found with respect to steel plates A - 4 and A - 5, as is shown in Table 2.

In the next series of experiments, blocks steel C were subjected to DQ after holding at 900° C. for 600, 120 and 30 seconds, respectively, immediately after the rolling with one of the rolling reduction of 70, 50, 30 and 0% in a temperature range between ($Ar_3$+150° C.) and 900° C. shown in Table 2. No grain boundary ferrite was seen in the quenched structures of these steel plates, but comparing the steel plate C - 1 with C - 2 and C - 3, the steel plate C - 1 (held for 600 seconds after rolling) is mainly composed of a martensite structure compared with the steel plate C - 2 (held for 120 seconds after rolling) and the steel plate C - 3 (held for 30 seconds after rolling), besides the martensite grain of the steel C - 1 was coarse. In contrast, in the steel plates C - 2 and C - 3, the martensite structure did not grow sufficiently, and they had a fine mixed structure of bainite and martensite and, in consequence, the Charpy vTrs values were obviously superior to that of the steel plate C - 1. This is because the rolled plates of C - 1 and C - 2 were quenched before the recovery of the rolled structure, so that the growth of the martensite structure was interfered in growth, resulting in the development of the fine mixed structure of bainite and martensite.

Comparing the steel plate C - 5 with the steel plate C - 6 in Table 2, the vTrs value of the plate C - 5 whose rolling reduction in the temperature range between $Ar_3$+150° C. and $Ar_3$ is large, is nearly the same level as that of the plates C - 2 and C - 3, but in the plate C - 6 whose rolling reduction was small, is inferior in vTrs. Thus, it is deemed that an accumulative rolling reduction of not smaller than 30% within the temperature range from $Ar_3$+150° C. to $Ar_3$ is indispensable to the present invention.

On the basis of the results of the above-described experiments, it is considered with respect to the manufacturing conditions of this invention that an accumulative rolling reduction of at least 30% within the temperature range between $Ar_3$ and to ($Ar_3$+150° C.) followed by the 30° C. within 120 seconds after the completion of rolling is essential. Though it is important that the quenching start temperature is substantially not smaller than $Ar_3$, since the temperature of the steel plate after rolling is usually measured by use of the surface temperature of the steel plate while the inner part of the steel plate to which the present invention relates is generally 30° C. or more higher than the surface temperature after being rolled, the quenching temperature is set to be not less than $Ar_3$−30° C.

Embodiment 2

Experiments on Composition Range of Steels to Which the Process of this Invention is applicable:

In order to clarify the composition ranges of the steels to which this invention is applicable, a series of experiments was carried out. Table 3 shows the compositions of the steels used for the experiment carried out for the purpose. All of the steels E to R shown in Table 3 are produced in accordance with the invention, and the steels S, T and U are steels used for comparison. Table 4 shows the conditions for the rolling and quenching steps of each steel shown in Table 3. The steel plates E - 1, H - 1, J - 1, M - 1, Q - 1, and R - 1 were directly subjected to the DQ process without being reheated after casting. Other steel plates were reheated to the temperatures shown in Table 4 before DQ process. Although the conditions for manufacturing the plates shown in FIG. 4 relate to the invention, the steel plate S - 1 is low in the value of $D_f$* hence the strength thereof exhibits a value lower than 50 Kg/mm$^2$. Further, in the steel plate T - 1 the amount of N is too high to obtain a superior value in Charpy vTrs. The Charpy vTrs of the steel plate U - 1 which contains excessive amount of B is remarkably inferior.

In comparison with these steels the steel plates relating to the invention exhibit appropriate strengths and excellent low temperature toughnesses in corresponding to their composition values.

As described above, this invention enables the producing of high tensile steel plates having excellent low temperature toughness and a tensile strength of not less than 50 Kgf/mm$^2$ by the DQT process. Steel plates according to the invention shall be applied to the following fields.

(a) quench-and-tempered type HT 50 to HT 100 steel plates used in steel structures which are used or installed mainly in the Tropical Zone or the Temperate Zones, such as crude oil storage tanks, various kinds of pressure vessels for use in ambient temperatures, line pipes, bridge girders, ships, and marine structure.

(b) HT 50 to HT 100 steel plates with a relatively high amount of Ni adopted for steel structures whose designed temperature is −20° C. or lower, such as storage tanks for liquefied petroleum gas, ships, marine construction, line pipes and various type of refrigerating machines.

The steel plates used in such applications have conventionally been manufactured by QT process, or by a multiple heat treatments by reheating. According to the present invention it becomes possible to produce steel plates having characteristics equivalent to or superior to those of conventional steel plates without the necessity for a reheating step after rolling. Thus, the present invention brings about advantageous effect industrially.

While there has been described what is at present considered to be preferred embodiments of the invention, it will be understood that various modifications may be made therein, and it is intended that the appended claims cover all such modifications as fall within the true spirit and scope of the invention.

TABLE 1

Compositions of Test Steel Used in Experiments for Researching Conditions of Rolling in DR and DQT Processes and for Researching the DQT condition (wt. %)

| Steel No. | C | Si | Mn | P | S | Cu | Ni | Cr | Mo | Nb | V | Ti | Zr | Al | B | N |
|---|---|---|---|---|---|---|---|---|---|---|---|---|---|---|---|---|
| A | 0.10 | 0.25 | 1.41 | 0.008 | 0.003 | 0 | 0 | 0 | 0 | 0.010 | 0 | 0 | 0 | 0.028 | 0.0011 | 0.0028 |
| B | 0.10 | 0.26 | 1.40 | 0.005 | 0.001 | 0 | 0 | 0 | 0.16 | 0.034 | 0 | 0 | 0 | 0.026 | 0.0012 | 0.0012 |
| C | 0.10 | 0.26 | 1.39 | 0.007 | 0.002 | 0 | 0 | 0 | 0 | 0.033 | 0 | 0 | 0 | 0.027 | 0.0008 | 0.0018 |
| D | 0.10 | 0.25 | 1.40 | 0.004 | 0.002 | 0 | 0 | 0 | 0 | 0.032 | 0 | 0 | 0 | 0.0029 | 0.0009 | 0.0037 |

TABLE 2

Conditions for Manufacturing Test Plates and Their Strength and Toughness which were used for Experiments on DQT Conditions in Embodiment 1

| Steel No. | Steel Plate No. | Plate Thickness | Presence of Reheating | Reheating Temperature | Rolling Starting Temperature | $Ar_3$ Measured | Accumulated Draft at Temperature between $Ar_3$ + 150° C. and $Ar_3$ |
|---|---|---|---|---|---|---|---|
| A | A-1 | 25 | Not Reheated | — | 1100° C. | 884° C. | 70% |
| ↓ | A-2 | ↓ | ↓ | ↓ | ↓ | ↓ | ↓ |
| ↓ | A-3 | ↓ | ↓ | ↓ | ↓ | ↓ | ↓ |
| ↓ | A-4 | ↓ | ↓ | ↓ | ↓ | ↓ | ↓ |
| ↓ | A-5 | ↓ | ↓ | ↓ | ↓ | ↓ | ↓ |
| ↓ | A-6 | ↓ | ↓ | ↓ | ↓ | ↓ | ↓ |
| B | B-1 | 25 | Not Reheated | — | 1150 | 771 | 70 |
| ↓ | B-2 | ↓ | ↓ | ↓ | ↓ | ↓ | ↓ |
| ↓ | B-3 | ↓ | ↓ | ↓ | ↓ | ↓ | ↓ |
| ↓ | B-4 | ↓ | ↓ | ↓ | ↓ | ↓ | ↓ |
| ↓ | B-5 | ↓ | ↓ | ↓ | ↓ | ↓ | ↓ |
| ↓ | B-6 | ↓ | ↓ | ↓ | ↓ | ↓ | ↓ |
| C | C-1 | 25 | Reheated | 1150° C. | 1050 | 810 | 70 (Note 1) |
| ↓ | C-2 | ↓ | ↓ | ↓ | ↓ | ↓ | ↓ |
| ↓ | C-3 | ↓ | ↓ | ↓ | ↓ | ↓ | ↓ |
| ↓ | C-4 | ↓ | ↓ | ↓ | ↓ | 805 | 50 |
| ↓ | C-5 | ↓ | ↓ | ↓ | ↓ | 801 | 30 |
| ↓ | C-6 | ↓ | ↓ | ↓ | ↓ | 793 | 0 |
| D | D-1 | 25 | Not Reheated | — | 1050 | 809 | 70 |
| ↓ | D-2 | ↓ | ↓ | ↓ | ↓ | 802 | 50 |
| ↓ | D-3 | ↓ | ↓ | ↓ | ↓ | 784 | 0 |
| ↓ | D-4 | ↓ | Reheated | 1150° C. | ↓ | 818 | 70 |
| ↓ | D-5 | ↓ | ↓ | ↓ | ↓ | 811 | 50 |
| ↓ | D-6 | ↓ | ↓ | ↓ | ↓ | 793 | 0 |

| Steel No. | Period of Time between the End of Rolling and Starting of DQ | DQ Starting Temperature | Average Cooling Rate of DQ | Strength after DQT YP/TS (Note 2) | Charpy vTrs after DQT | Remarks |
|---|---|---|---|---|---|---|
| A | 10 sec. | 866° C. | 40° C./sec | 44.2/55.9 Kgf/mm$^2$ | −85° C. | Method according |
| ↓ | 30 | 860 | ↓ | 45.1/57.1 | −79 | to the Invention |
| ↓ | 60 | 854 | ↓ | 44.8/54.6 | −72 | ↓ |
| ↓ | 120 | 817 | ↓ | 41.5/53.1 | −73 | Method adopted |
| ↓ | 180 | 744 | ↓ | 36.5/48.0 | −53 | for Comparison |
| ↓ | 300 | 643 | ↓ | 34.3/46.1 | −50 | ↓ |
| B | 10 | 924 | 40 | 78.1/84.7 | −86 | Method according |
| ↓ | 30 | 921 | ↓ | 79.8/87.3 | −83 | to the Invention |
| ↓ | 60 | 895 | ↓ | 79.2/86.8 | −79 | ↓ |
| ↓ | 120 | 879 | ↓ | 78.4/85.4 | −70 | Method adopted |
| ↓ | 180 | 808 | ↓ | 57.6/68.1 | −37 | for Comparison |
| ↓ | 300 | 743 | ↓ | 42.0/57.4 | −25 | ↓ |
| C | 600 | 900 | 40 | 69.7/75.1 | −43 | Method adopted |
| ↓ | 120 | ↓ | ↓ | 68.6/74.3 | −72 | for Comparison |
| ↓ | 30 | ↓ | ↓ | 65.1/72.7 | −85 | Method according |
| ↓ | ↓ | ↓ | ↓ | 63.6/71.2 | −81 | to the Invention |
| ↓ | ↓ | ↓ | ↓ | 63.3/71.0 | −76 | ↓ |
| ↓ | ↓ | ↓ | ↓ | 68.8/77.2 | −23 | ↓ |
| D | 30 | 870 | ↓ 72.3/78.6 | −35 | Method adopted | |
| ↓ | ↓ | ↓ | ↓ | 71.6/80.1 | −26 | for Comparison |
| ↓ | ↓ | ↓ | 40 | 70.4/79.8 | −30 | Method adopted |
| ↓ | ↓ | ↓ | ↓ | 59.3/66.6 | −43 | for Comparison |
| ↓ | ↓ | ↓ | ↓ | 56.5/67.2 | −38 | ↓ |
| ↓ | ↓ | ↓ | ↓ | 54.1/69.2 | −42 | ↓ |

(Note 1)
Six steel plates C-1 to C-6 were rolled within the temperature range of more than 900° C., next heated to and held at 900° C. for a predetermined time, and then quenched.
(Note 2)
Tempered at 600° C. and held for 15 minutes.

TABLE 3

Compositions of Test Steels Used for Embodiment 2

| Steel Code | Compositions (weight %) C | Si | Mn | P | S | Cu | Ni | Cr | Mo | Nb | V | Ti | Zr | Al | B | N | $D_f$* | Remark |
|---|---|---|---|---|---|---|---|---|---|---|---|---|---|---|---|---|---|---|
| E | 0.12 | 0.24 | 1.41 | 0.015 | 0.004 | — | — | — | — | — | — | 0.012 | — | 0.049 | 0.0012 | 0.0013 | 1.10 | Steel in |
| F | 0.09 | 0.27 | 1.34 | 0.019 | 0.003 | — | — | 0.22 | — | — | 0.043 | 0.022 | — | 0.032 | 0.0009 | 0.0018 | 1.26 | accordance |
| G | 0.11 | 0.18 | 1.46 | 0.007 | 0.001 | — | 0.42 | 0.16 | 0.23 | — | — | — | 0.008 | 0.039 | 0.0017 | 0.0025 | 2.98 | with the |
| H | 0.06 | 0.29 | 1.28 | 0.009 | 0.002 | — | — | 0.23 | 0.17 | — | 0.039 | 0.014 | 0.006 | 0.035 | 0.0013 | 0.0022 | 1.64 | Invention |
| I | 0.10 | 0.27 | 1.56 | 0.012 | 0.001 | 0.32 | 0.43 | — | — | — | 0.052 | 0.008 | — | 0.026 | — | 0.0029 | 1.16 | ↓ |
| J | 0.09 | 0.18 | 1.41 | 0.003 | 0.001 | — | — | — | — | 0.032 | — | 0.018 | — | 0.025 | 0.0008 | 0.0011 | 0.84 | ↓ |
| K | 0.07 | 0.23 | 1.44 | 0.005 | 0.001 | 0.42 | 0.28 | — | 0.18 | — | — | 0.017 | — | 0.003 | — | 0.0014 | 1.33 | ↓ |
| L | 0.06 | 0.14 | 1.42 | 0.004 | 0.002 | — | — | — | 0.14 | 0.042 | — | 0.016 | — | 0.002 | 0.0014 | 0.0015 | 1.08 | ↓ |
| M | 0.20 | 0.37 | 0.98 | 0.022 | 0.008 | — | — | 0.31 | — | — | — | 0.009 | — | 0.037 | 0.0006 | 0.0022 | 1.41 | ↓ |
| N | 0.07 | 0.22 | 0.72 | 0.004 | 0.002 | — | 3.78 | — | — | — | — | 0.015 | — | 0.027 | — | 0.0029 | 0.64 | ↓ |
| O | 0.06 | 0.19 | 0.92 | 0.005 | 0.003 | — | 2.41 | — | — | 0.015 | — | 0.014 | — | 0.003 | — | 0.0014 | 0.65 | ↓ |
| P | 0.07 | 0.25 | 1.21 | 0.008 | 0.002 | — | 1.54 | — | 0.10 | — | — | 0.017 | — | 0.004 | — | 0.0019 | 1.11 | ↓ |
| Q | 0.16 | 0.01 | 1.48 | 0.006 | 0.001 | 0.35 | 0.24 | — | — | — | — | 0.016 | — | 0.003 | 0.0012 | 0.0017 | 1.42 | ↓ |
| R | 0.13 | 0.42 | 1.37 | 0.023 | 0.006 | — | — | — | — | 0.021 | — | 0.014 | — | 0.051 | 0.0010 | 0.0030 | 1.18 | ↓ |
| S | 0.09 | 0.27 | 1.02 | 0.012 | 0.002 | — | — | — | — | — | — | — | — | 0.037 | — | 0.0027 | 0.50 | Steel |
| T | 0.11 | 0.21 | 1.52 | 0.009 | 0.002 | 0.31 | 0.39 | — | — | — | 0.049 | — | — | 0.023 | — | 0.0037 | 1.10 | Employed for Comparison |
| U | 0.11 | 0.26 | 1.43 | 0.011 | 0.003 | — | 0.38 | — | 0.21 | — | — | — | — | 0.036 | 0.0031 | 0.0026 | 2.34 | ↓ |

TABLE 4

Conditions for Manufacturing Test Plates and Their Mechanical Strength and which were used for Example 2

| Steel No. | Steel Plate No. | Plate Thickness mm | Presence of Reheating | Reheating Temperature °C. | Rolling Starting Temperature °C. | Accumulated Rolling Reduction $R_N$ at Temperature between $Ar_3$ + 150° C. and $Ar_3$ % | Value of $Ar_3$ °C. |
|---|---|---|---|---|---|---|---|
| E | E-1 | 25 | Not Reheated | — | 1100 | 67 | 845 |
| | E-2 | 25 | Reheated | 1100 | 1050 | 67 | 861 |
| F | F-1 | 50 | Reheated | 1200 | 1100 | 50 | 857 |
| G | G-1 | 50 | Reheated | 1100 | 1050 | 67 | 848 |
| H | H-1 | 38 | Not Reheated | — | 1100 | 65 | 881 |
| | H-2 | 38 | Reheated | 1150 | 1100 | 65 | 872 |
| I | I-1 | 38 | Reheated | 1200 | 1100 | 62 | 775 |
| J | J-1 | 25 | Not Reheated | — | 1100 | 70 | 804 |
| | J-2 | 25 | Reheated | 1250 | 1100 | 70 | 805 |
| K | K-1 | 80 | Reheated | 1200 | 1100 | 50 | 850 |
| L | L-1 | 32 | Reheated | 1200 | 1100 | 66 | 794 |
| M | M-1 | 20 | Not Reheated | — | 1100 | 67 | 846 |
| N | N-1 | 38 | Reheated | 1100 | 1050 | 70 | 702 |
| O | O-1 | 32 | Reheated | 1100 | 1050 | 70 | 738 |
| P | P-1 | 32 | Reheated | 1100 | 1050 | 70 | 759 |
| Q | Q-1 | 65 | Not Reheated | — | 1100 | 60 | 830 |
| R | R-1 | 19 | Not Reheated | — | 1100 | 70 | 862 |
| S | S-1 | 25 | Reheated | 1100 | 1050 | 68 | 870 |
| T | T-1 | 38 | Reheated | 1100 | 1050 | 55 | 801 |
| U | U-1 | 50 | Reheated | 1200 | 1100 | 60 | 910 |

| Steel No. | Period of time between the End of Rolling and Starting of DQ sec | DQ Starting Temperature °C. | Average Cooling Rate of DQ °C./sec | Tensile Strength of Steel Plate after DQT YP Kg/mm² | TS Kg/mm² | 2 mmV Charpy vTrs °C. | Tempering Temperature °C. |
|---|---|---|---|---|---|---|---|
| E | 20 | 840 | 45 | 61.5 | 72.8 | −73 | 620 |
| | 20 | 840 | 45 | 52.4 | 65.7 | −79 | " |
| F | 30 | 870 | 21 | 59.0 | 73.8 | −68 | 610 |
| G | 30 | 850 | 21 | 68.2 | 76.3 | −120 | " |
| H | 30 | 870 | 28 | 58.7 | 67.7 | −83 | 630 |
| | 30 | 870 | 28 | 52.1 | 65.2 | −92 | " |
| I | 30 | 800 | 28 | 55.9 | 71.7 | −81 | 640 |
| J | 30 | 850 | 45 | 57.2 | 61.5 | −90 | 630 |
| | 30 | 850 | 45 | 56.9 | 61.3 | −103 | " |
| K | 20 | 850 | 16 | 52.8 | 63.2 | −65 | 620 |
| L | 30 | 830 | 35 | 58.6 | 62.4 | −115 | " |
| M | 20 | 830 | 55 | 66.1 | 82.6 | −62 | 630 |
| N | 60 | 720 | 28 | 53.4 | 61.6 | <−160 | 550 |
| O | 120 | 720 | 35 | 55.8 | 62.3 | <−160 | 550 |
| P | 60 | 770 | 35 | 49.2 | 56.1 | <−160 | 600 |
| Q | 20 | 830 | 16 | 49.5 | 68.2 | −80 | " |
| R | 15 | 850 | 60 | 71.5 | 77.6 | −121 | 620 |
| S | 20 | 890 | 45 | 36.1 | 46.4 | −78 | " |
| T | 30 | 850 | 28 | 52.0 | 63.7 | −42 | 640 |

TABLE 4-continued

| Conditions for Manufacturing Test Plates and Their Mechanical Strength and which were used for Example 2 | | | | | | | |
|---|---|---|---|---|---|---|---|
| U | 30 | 900 | 21 | 54.3 | 63.9 | +15 | 660 |

What is claimed is:

1. A method for manufacturing high tensile-high toughness steel plate comprising the steps of:

preparing a molten steel alloy consisting, by weight, of
0.03 to 0.20% C,
0.01 to 0.70% Si,
0.50 to 1.80% Mn,
one or two selected from the group consisting of 0.005 to 0.05% Ti and 0.005 to 0.05% Zr,
0.005 to 0.10% Nb,
not greater than 0.025% P,
not greater than 0.015% S,
not greater than 0.080% Al,
not greater than 0.0030% N, and
the balance Fe and impurities incidentally mixed in the normal steel manufacturing process and having a value not smaller than 0.60 of $D_f^*$ defined by formula:

$$D_f^* = 1.11 \cdot \sqrt{(\text{weight \% of C})} \cdot [1 + 0.7 \cdot (\text{weight \% of Si})] \cdot$$

-continued $$[5.1 \cdot (\text{weight \% of Mn}) - 1.12]$$

preparing a steel slab or ingot by casting the said molten steel alloy, rolling said slab or ingot with an accumulative rolling reduction of at least 30% in a temperature range between ($Ar_3$+150° C.) and $Ar_3$ during a cooling after casting, or in another cooling after reheating a cold steel slab or ingot in a temperature range between 1000° C. and 1300° C., quenching the rolled steel alloy from a temperature not less than ($Ar_3$−30° C.) within a period of time in which neither recovering nor recrystallization substantially occur, and tempering at a temperature of not higher than $Ac_1$.

2. The method of claim 1 wherein said steel plate has a tensile strength of at least 50 kg/mn$^2$.

3. A method for producing high tensile-high toughness steel plates according to claim 1, wherein said steel slab or ingot further contains 0.0003 to 0.0030 weight % B.

4. A method for producing high tensile-high toughness steel plates according to claim 1, wherein the rolled steel is quenched within 120 seconds after the finishing of rolling effected in the temperature range from $Ar_3$+150° C. to $Ar_3$.

* * * * *

UNITED STATES PATENT AND TRADEMARK OFFICE

CERTIFICATE OF CORRECTION

PATENT NO. : 4,790,885

DATED : December 13, 1988

INVENTOR(S) : Imagumbai et al

It is certified that error appears in the above—identified patent and that said Letters Patent is hereby corrected as shown below:

In column 1:
line 39, change "beheviour" to -- behavior --.
line 55, change "to hold" to --that--;
line 56, after "plates" insert --be held--;
line 67, change "scarecely" to --scarcely--.

In column 2:
line 2, change "on" to --the--.

In column 4:
line 57, change "Ni-additioning" to --Ni addition of--.

In column 5:
line 2, change "cluster" to --clusters--;
line 66, change "differ" to --differs--.

In column 6:
line 14, change "practise" to --practice--.
In claim 1, line 8, after "Ti" delete "and" in favor of -- , --; after "Zr" insert -- and --.

Signed and Sealed this

Fifth Day of December, 1989

*Attest:*

JEFFREY M. SAMUELS

*Attesting Officer* *Acting Commissioner of Patents and Trademarks*